US005781218A

United States Patent [19]

Wakahara et al.

[11] Patent Number: 5,781,218

[45] Date of Patent: Jul. 14, 1998

[54] IMAGE FORMING APPARATUS

[75] Inventors: Shirou Wakahara, Osaka; Kazuya Masuda, Nara, both of Japan

[73] Assignee: Sharp Kabushiki Kaisha, Osaka, Japan

[21] Appl. No.: 800,651

[22] Filed: Feb. 4, 1997

[30] Foreign Application Priority Data

Feb. 6, 1996 [JP] Japan ..... 8-019690
Feb. 6, 1996 [JP] Japan ..... 8-019691

[51] Int. Cl.[6] ..... B41J 2/39; B41J 2/395

[52] U.S. Cl. ..... 347/141; 347/55

[58] Field of Search ..... 347/141, 143, 347/144, 147, 151, 55

[56] References Cited

U.S. PATENT DOCUMENTS

| | | | |
|---|---|---|---|
| 5,231,427 | 7/1993 | Ohashi . | |
| 5,329,307 | 7/1994 | Takemura et al. | 347/151 |
| 5,353,050 | 10/1994 | Kagayama . | |
| 5,404,155 | 4/1995 | Kitamura | 347/55 X |
| 5,453,768 | 9/1995 | Schmidlin | 347/55 |
| 5,477,250 | 12/1995 | Larson | 347/55 |
| 5,523,777 | 6/1996 | Kitamura | 347/55 |
| 5,600,355 | 2/1997 | Wada | 347/55 |
| 5,614,932 | 3/1997 | Kagayama | 347/55 |
| 5,629,726 | 5/1997 | Yamasa | 347/55 |

FOREIGN PATENT DOCUMENTS

| | | |
|---|---|---|
| 6-155798 | 6/1994 | Japan . |
| 7-101099 | 4/1995 | Japan . |

*Primary Examiner*—Matthew S. Smith
*Attorney, Agent, or Firm*—David G. Conlin; William J. Daley, Jr.

[57] ABSTRACT

An image forming apparatus includes: an opposing electrode disposed facing a supporting device; a control electrode disposed between the supporting device and the opposing electrode and having a plurality of gates which form passages for the developer particles; a controlling device which generates a predetermined potential difference between the supporting device and the opposing electrode, supplies a voltage to the control electrode, and, by varying the potential applied to the control electrode, controls passage of the gates for the developer particles; and a plurality of voltage supplying device to supply voltages to the control electrode.

5 Claims, 8 Drawing Sheets

IMAGE FORMING APPARATUS

BACKGROUND OF THE INVENTION (1) Field of the Invention

The present invention relates to an image forming apparatus which forms the image on a recording medium by causing developer particles to jump thereto and can be applied to a printer unit in digital copiers and facsimile machines as well as to digital printers, plotters, etc.

(2) Description of the Prior Art

In recent years, as the image forming means for outputting a visual image on recording medium such as paper etc., in response to an image signal, an image forming apparatus is disclosed in Japanese Patent Application Laid-Open Hei 6 No. 155,798, for example, in which developer particles, i.e., toner, are made to directly adhere to the recording medium to thereby form a toner image on it, directly. Referring to FIG. 1, the above conventional image forming apparatus will be discussed hereinbelow.

In the above image forming apparatus, as shown in FIG. 1, includes an image forming unit 53 having a toner supplying section 51 and a printing section 52. In this apparatus, toner 54 is made to jump to and adhere to a sheet of paper 55 as a recording medium. During this operation, the jumping of toner 54 is controlled in accordance with an image signal so as to form the image, directly on paper 55.

Toner supplying section 51 is composed of a toner reservoir 56 for holding negatively charged developer particles, toner 54, and a toner support 57 for supporting toner 54 by magnetic force. Toner support 57 is grounded and rotationally driven in the direction indicated by arrow E in the figure, with its surface speed set at 30 mm/sec. Toner 54 is of a magnetic type having a mean particle diameter of 10 μm, and is electrified with static charge of −4 μC/g to −5 μC/g by a well-known technique. Toner 54 is carried on the peripheral surface of toner support 57 with a mean thickness of about 80 μm.

Printing section 52 as a part of image forming unit 53 is composed of an opposing electrode 58 made up of an aluminum pipe of 50 mm in diameter, and a control electrode 59 which is provided between opposing electrode 58 and a toner support 57. Opposing electrode 58 is arranged about 1 mm apart from the peripheral surface of toner support 57, has a high voltage of 2 kV applied from a d.c. power source 60, and rotates in the direction of arrow F in FIG. 1, with its surface speed set at 30 mm/sec, or at the same peripheral speed as toner support 57. Therefore, generated between opposing electrode 58 and toner support 57 is an electric field needed to cause toner 54 supported on toner support 57 to jump toward opposing electrode 58.

Control electrode 59 is disposed in parallel to a tangent plane of the surface of opposing electrode 58 and spreads two-dimensionally facing opposing electrode 58, and it has a structure which permits the toner to pass therethrough from toner support 57 to opposing electrode 58. The electric field formed between toner support 57 and opposing electrode 58 varies depending on the potential being applied to control electrode 59, so that the jumping of toner 54 from toner support 57 to opposing electrode 58 is controlled.

Control electrode 59 is arranged so that its distance from the peripheral surface of toner support 57 is set at 100 μm. Control electrode 59 is composed of a flexible print board (FPC) **59*a* of 50 μm thick and annular electrodes 61 of a copper foil of 20 μm thick. Board 59*a* has gates 62 having a diameter of 150 μm forming passages of toner 54. Around these gates 62 are arranged the aforementioned annular electrodes 61. Each annular electrode 61 is electrically connected via a feeder line and high-voltage driver to a control power source 63**.

This control power source 63 (in FIG. 2) is composed of: a first power source 64 for imparting a voltage of 150V to the annular electrodes 61, which permits passage of toner 54 through gate 62; a second power source for imparting a voltage of −200V to the annular electrodes 61, which prohibits passage of toner 54 through gate 62; a FET with a pull-up resistance 66 as a voltage selector; and an image signal control circuit 68. Normally, FET 67 is activated depending upon image signal control circuit 68 so as to impart a voltage prohibiting passage of toner 54 through gate 62, to annular electrode 61. When FET 67 is deactivated by image signal control circuit 68, a voltage for causing toner 54 to pass through gate 62 is supplied to annular electrode 61. Control power source 63 applies the voltage in accordance with the image signal to annular electrode 61. More specifically, control power source 63 applies a voltage of 150 V for 300 μsec to annular electrode 61 if toner 54 supported on toner support 57 should pass through it toward opposing electrode 58. When the toner is prohibited from passing, a voltage of −200 V is applied. In this way, when application of voltage to control electrode 59 is controlled in accordance with the image signal whilst paper 55 is fed to the side of opposing electrode 58 facing toner support 57, the toner image in accordance with the image signal is directly formed on the surface of paper 55.

The aforementioned rotation of toner support 57, rotation of opposing electrode 58, application of the voltage to control electrode 59 for prohibiting toner 54 from passing therethrough and application of the high voltage to opposing electrode 58 are activated at almost the same time by a single trigger.

In the conventional image forming apparatus, the voltage applied to the control electrode was supplied to a transistor etc., through a resistor. Therefore, current flowed through the transistor during a certain period of time, generating heat so that the transistor often malfunctioned. To deal with this, a cooling means for cooling the transistor was provided, inevitably increasing the number of parts and the cost.

As to the number of power sources for supplying control voltages, one power source is generally allotted for one level of voltage. In this case, electric power is supplied from a single power source to all the electrodes to which the voltage for control is applied. Even if the required power for control of each electrode is minimal, the power source for supplying the voltage to the control electrode needs a very high current capacity because there are many electrodes (e.g., 2,560 electrodes in the above conventional example). In particular, when the voltage is supplied to the transistor through a capacitor, no continuous current flows, therefore no heat will be generated unlike the case where a resistor is used.

However, the moment the potential is changed, transient current for charging or discharging the capacitor flows. Since, as for one channel, the transient current usually flows for a very short span of time. In practice, however, a great number of channels are continuously controlled at the same time and each peak current can become considerably high. In the image forming operation, when a large number of transistors connected to one power source are made to repeatedly operate for switching, the power source resultantly needs a high current capacity.

In one word, the control using capacitors needs to especially take measures against momentary transient current. If a large current flows from a power source of a low current capacity, the output voltage decreases causing insufficiency of the potential to be applied to the control electrode. This causes improper toner jumping. In the control using capacitors, although no continuous pulse current flows as mentioned above, a voltage drop occurs due to the transient current when the voltage is changed over. As a result, it is impossible to generate a proper electric field acting on the toner, therefore the substantial application time of the toner jump field becomes shortened.

Further, other problems which make the printing unstable occur: for example, as the number of channels to be turned on increases, the time during which the applied voltage is weakened becomes long. In order to avoid this problem, the voltage application time needs to be set longer. However, this lengthens the total print time, making it difficult to increase the speed and resolution.

When the power source has a high current capacity, the power source itself cannot but heat and the power source itself may malfunction or the heat emitted affects other circuits whereby the operation of the apparatus may become unstable. Further, there is a risk that the power source itself might become broken. For a stabilized operation of the apparatus, a cooling means was needed, thus increasing the number of parts and the cost for the cooling means.

Since the heat generation becomes more obvious when the power source is made compact, it has been difficult to achieve this. Further, with a power source having a large current capacity, reduction in cost is limited, and the control voltage might be short-circuited or applied to other circuits. High-voltage may be applied not only to the whole apparatus, but also it might be unexpectedly applied directly to the user who accidentally touches it. If such a case happened, not only are other circuits broken but the whole apparatus may be disabled, and the user might be struck by electricity in the worst case. In order to avoid the hazard of electric shock or the current leakage to other circuits, the power source or the entire apparatus body needs to be insulated to the highest degree. This inevitably makes the apparatus markedly large and increases the number of parts and the cost.

SUMMARY OF THE INVENTION

As has been described heretofore, in the conventional art, since electric power is supplied from a single power source to all the electrodes of the control electrode, even if the required power for control of each electrode is minimal, the power source for supplying voltage to the control electrode needs a very high current capacity because there are many electrodes. As a result, the power source generates heat thus making itself malfunction or adversely affecting other circuits. The present invention has been devised to solve the above problem, and the gist of the invention is as follows:

In order to solve the above problem, the image forming apparatus in accordance with the first aspect of the invention, comprises:

a supporting means for supporting developer particles;

an opposing electrode disposed facing the supporting means;

a control electrode disposed between the supporting means and the opposing electrode and having a plurality of gates which form passages for the developer particles;

a recording medium which is conveyed between the control electrode and the opposing electrode and is recorded with an image; and a controlling means which generates a predetermined potential difference between the supporting means and the opposing electrode and, by varying the potential applied to the control electrode, controls passage of the gates for the developer particles so as to create the image on the recording medium which is conveyed between the control electrode and the opposing electrode, wherein a plurality of voltage supplying means are provided to supply voltages to the control electrode.

In this configuration, since the current from each power source can be kept low by using a multiple number of power sources, each power source need not have a high current capacity, thus making it possible to avoid adverse effects due to heat generation.

In accordance with the second aspect of the invention, in the image forming apparatus having the first feature, the apparatus has a multiple number of voltage supplying means, each of which is a power source having a maximum current supplying capacity of under 70 mA.

In this configuration, since, a multiple number of power sources are used and since the current from each of them is set under 70 mA, it is possible to avoid the hazard of electric shock due to current leakage as well as breakdown of other electric circuits without necessity of a large-scale insulating means.

The image forming apparatus in accordance with the third aspect of the invention, comprises:

a supporting means for supporting developer particles;

a driving means for driving the supporting means at a certain surface speed;

an opposing electrode disposed facing the supporting means;

a control electrode which is disposed between the supporting means and the opposing electrode, has a plurality of gates which form passages for the developer particles, and includes a first and second control electrode group, each composed of a plurality of electrodes formed around the plural gates, so that the developer particles can be caused to jump toward the recording medium through the openings corresponding to selected electrodes in accordance with the voltage applied thereto; and a controlling means which applies a predetermined potential difference to the electrodes corresponding to the first and second electrode groups when the developer particles pass through the openings; and a plurality of voltage supplying means for supplying voltages to the control electrode, wherein an image is formed by controlling passage of the developer particles through the gates by applying the predetermined voltage to the electrodes corresponding to first and second electrode groups.

In this configuration, since a plurality of power sources are also used when a matrix control configuration is applied to the control electrode, it is possible to use power sources with low capacities.

In accordance with the fourth aspect of the invention, in the image forming apparatus having the third feature, each voltage supplying means has a maximum current supplying capacity of under 70 mA.

In this configuration, since the current from each of the power sources is set under 70 mA, it is possible to avoid the hazard of electric shock due to current leakage as well as breakdown of other electric circuits without necessity of a large-scale insulating means.

The image forming apparatus in accordance with the fifth aspect of the invention, comprises:

a plurality of supporting means, each supporting developer particles of a different color;

driving means for driving the supporting means at a certain surface speed;

an opposing electrode disposed facing the supporting means;

a control electrode which is disposed between the supporting means and the opposing electrode, has a plurality of gates which form passages for the developer particles, and includes first and second control electrode groups, each composed of a plurality of electrodes formed around the plural gates, so that the developer particles can be caused to jump toward the recording medium through the openings corresponding to selected electrodes in accordance with the voltage applied thereto;

a controlling means which applies a predetermined potential difference to the electrodes corresponding to the first and second electrode groups when the developer particles pass through the openings; and a plurality of voltage supplying means for supplying voltages to the control electrode, each voltage supplying means having a maximum current supplying capacity of under 70 mA, wherein an image is formed by controlling passage of the developer particles through the gates by applying the predetermined voltage to the electrodes corresponding to first and second electrode groups.

In this configuration, it is possible to use matrix control of the control electrodes for a color image forming apparatus. The use of a plurality of power sources makes it possible to suppress the current from each of the power sources. Further, the current from each of them is set under 70 mA, it is possible to avoid the hazard of electric shock due to current leakage as well as breakdown of other electric circuits without necessity of a large-scale insulating means.

The image forming apparatus in accordance with the sixth aspect of the invention, comprises:

a supporting means for supporting developer particles;

an opposing electrode disposed facing the supporting means;

a control electrode disposed between the supporting means and the opposing electrode and having a plurality of gates which form passages for the developer particles;

a recording medium which is conveyed between the control electrode and the opposing electrode and is recorded with an image; and a controlling means which generates a predetermined potential difference between the supporting means and the opposing electrode and, by varying the potential applied to the control electrode, controls passage of the gates for the developer particles so as to create the image on the recording medium which is conveyed between the control electrode and the opposing electrode, wherein the controlling means comprises:

at least two, a first and a second voltage supplying means, the first voltage supplying means applying a first level of voltage to set the gates of the control electrode into a first state in which the developer particles are permitted to pass therethrough, and the second voltage supplying means applying a second level of voltage to set the gates of the control electrode into a second state in which the developer particles are prohibited from passing therethrough;

an element providing, but not limited to, capacitance; and a voltage selecting means for selecting one level from multiple levels of voltage containing the first and second levels of voltage to apply the selected voltage to the control electrode, at least one of the first and second voltage supplying means having a plurality of power sources, and at least one of the first and second voltages being supplied to the voltage selecting means via the element providing capacitance.

In this configuration, since the voltage is applied to the selector through a capacitance element, pulse current hardly flows in contrast to the case where a resistance element was used. As a result, it is possible to reduce not only the current capacity of the power source but also that of the selector. Further, by using a plurality of power sources, it is also possible to suppress the average current from each of the power sources. Accordingly, it is possible to avoid heat generation due to current and voltage drop occurring when the applied voltage to the control electrode is changed over. Since no adverse effects due to heat generation will arise, there is no need of providing a cooling means.

In accordance with the seventh aspect of the invention, in the image forming apparatus having the sixth feature, the first and second voltage supplying means both have a maximum current supplying capacity of under 70 mA.

In this configuration, since the use of a plurality of power sources can keep low the current from each of them and since each current capacity is set under 70 mA, it is possible to prevent the hazard of electric shock due to current leakage and the breakdown in other circuits or apparatuses.

The image forming apparatus in accordance with the eighth aspect of the invention, comprises:

a supporting means for supporting developer particles;

a driving means for driving the supporting means at a certain surface speed;

an opposing electrode disposed facing the supporting means;

a control electrode which is disposed between the supporting means and the opposing electrode, has a plurality of gates which form passages for the developer particles, and includes a first and a second control electrode group, each composed of a plurality of electrodes formed around the plural gates, so that the developer particles can be caused to jump toward the recording medium through the openings corresponding to selected electrodes in accordance with the voltage applied thereto; and a controlling means which applies a predetermined potential difference to the electrodes corresponding to the first and second electrode groups when the developer particles pass through the openings; and a plurality of voltage supplying means for supplying voltages to the control electrode, wherein the controlling means comprises:

at least two, a first and a second voltage supplying means, the first voltage supplying means applying a first level of voltage to set the gates of the control electrode into a first state in which the developer particles are permitted to pass therethrough, and the second voltage supplying means applying a second level of voltage to set the gates of the control electrode into a second state in which the developer particles are prohibited from passing therethrough;

an element providing, but not limited to, capacitance; and a voltage selecting means for selecting one level from multiple levels of voltage containing the first and second levels of voltage to apply the selected voltage to the control electrode, at least one of the first and second voltage supplying means having a plurality of power sources, and at least one of the first and second voltages being supplied to the voltage selecting means via the element providing capacitance.

In this configuration, it is possible to have the same effect as stated above even when the control electrode is in the form of a matrix control configuration.

The image forming apparatus in accordance with the ninth aspect of the invention, comprises:

a plurality of supporting means, each supporting developer particles of a different color;

driving means for driving the supporting means at a certain surface speed;

an opposing electrode disposed facing the supporting means;

a control electrode which is disposed between the supporting means and the opposing electrode, has a plurality of gates which form passages for the developer particles, and includes a first and a second control electrode group, each composed of a plurality of electrodes formed around the plural gates, so that the developer particles can be caused to jump toward the recording medium through the openings corresponding to selected electrodes in accordance with the voltage applied thereto; and a controlling means which applies a predetermined potential difference to the electrodes corresponding to the first and second electrode groups when the developer particles pass through the openings, wherein an image is formed by controlling passage of the developer particles through the gates by applying the predetermined voltage to the electrodes corresponding to first and second electrode groups, said image forming apparatus being characterized in that the controlling means comprises:

at least two, a first and a second voltage supplying means, the first voltage supplying means applying a first level of voltage to set the gates of the control electrode into a first state in which the developer particles are permitted to pass therethrough, and the second voltage supplying means applying a second level of voltage to set the gates of the control electrode into a second state in which the developer particles are prohibited from passing therethrough;

an element providing, but not limited to, capacitance; and a voltage selecting means for selecting one level from multiple levels of voltage containing the first and second levels of voltage to apply the selected voltage to the control electrode, at least one of the first and second voltage supplying means having a plurality of power sources, and at least one of the first and second voltages being supplied to the voltage selecting means via the element providing capacitance.

In this configuration, it is possible to use matrix control of the control electrodes for a color image forming apparatus and it is possible to have the same effect as stated above.

In the above sixth through ninth configurations, since capacitance elements can be printed on an FPC board, it is possible to make the circuit compact.

DESCRIPTION OF THE PREFERRED EMBODIMENTS

Referring to the accompanying drawings, the present invention will hereinafter be described in detail as follows. Although the image forming apparatus using negatively charged toner will be detailed in the description in the following description, the polarity of voltage to be applied may be appropriately set if positive charged toner is used.

Overall configuration of each components of the image forming apparatus in accordance with this embodiment will be described.

Figure 3:
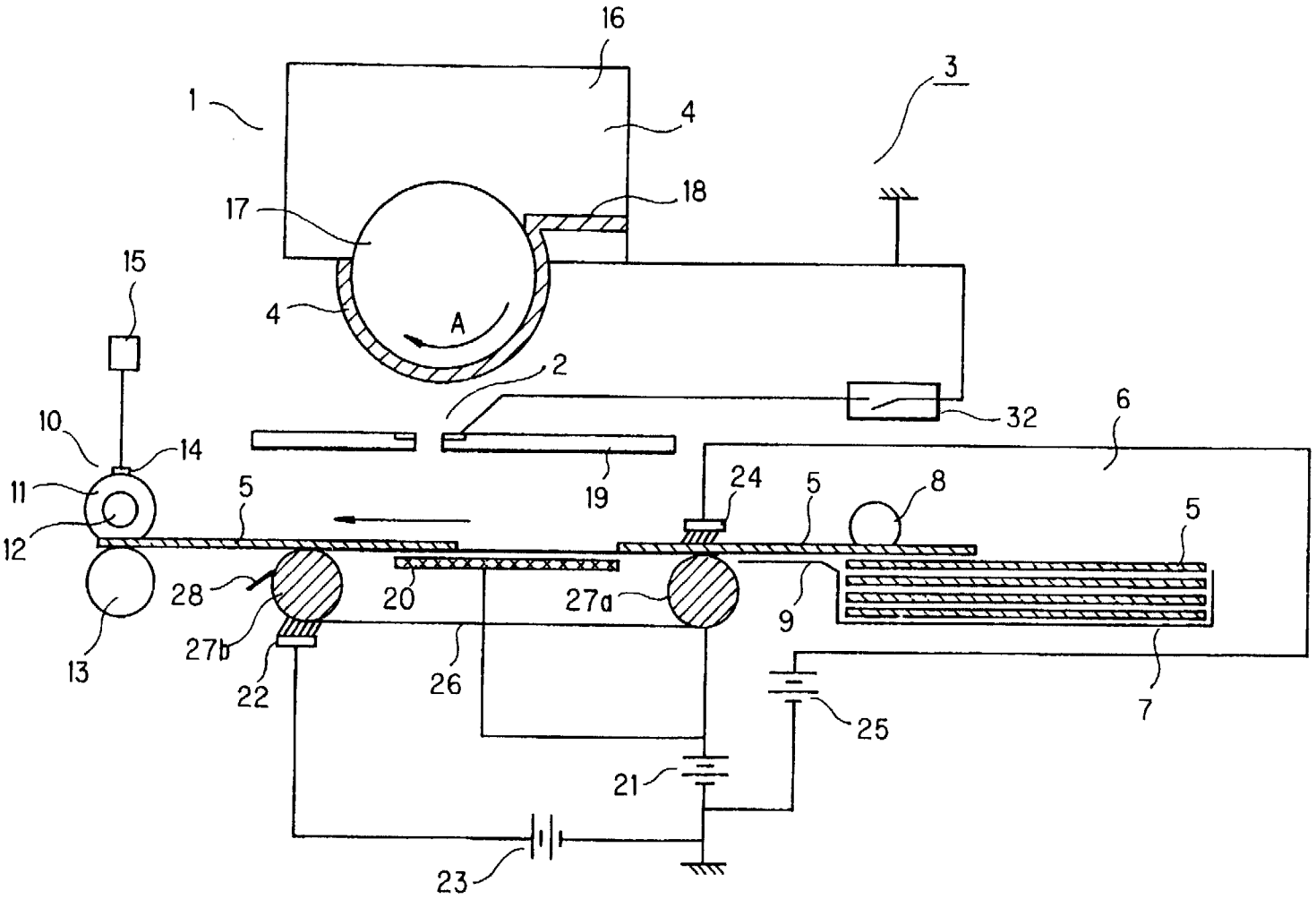
FIG. 3 is a schematic illustrative view showing the overall configuration of an image forming apparatus in accordance with an embodiment of the invention.

As shown in FIG. 3, the image forming apparatus of this embodiment has an image forming unit 3 which is composed of a toner supplying section 1 and a printing section 2. Image forming unit 3 creates a visual image in accordance with an image signal, onto a sheet of paper 5 as recording medium with toner 4 as developer particles. In this image forming apparatus, toner 4 is selectively made to jump and adhere onto paper 5, and the jumping of toner 4 is controlled based on the image signal, so as to directly create the image on paper 5.

A paper feeder 6 is provided on the side of image forming unit 3 to which paper 5 is fed. Paper feeder 6 is composed of a paper cassette 7 for storing paper 5 as recording medium, a pickup roller 8 for delivering paper 5 from paper cassette 7, and a paper guide 9 for guiding paper 5 sent out. Paper feeder 6 further has unillustrated detecting sensors for detecting the feed of paper 5. Pickup roller 8 is rotationally driven by means of an unillustrated driver. Provided on the output side of image forming unit 3 from which paper 5 is outputted, is a fixing unit 10 for heating and pressurizing the toner image which was formed on paper 5 at the image forming unit 3, to fix it onto paper 5. Fixing unit 10 is composed of a heat roller 11, a heater 12, a pressure roller 13, a temperature sensor 14, and a temperature controller circuit 15.

Heat roller 11 is made up of, for example, an aluminum pipe of 2 mm thick. Heater 12 is a halogen lamp, for example, which is incorporated in heat roller 11. Pressure roller 13 is made up of, for example, silicone resin. Heat roller 11 and pressure roller 13 which are arranged opposite each other, are pressed against one another in order to hold paper 5 in between and pressurize it, with a pressurizing load, e.g. 2 kg, from unillustrated springs etc., provided at both ends of their shafts. Temperature sensor 14 measures the surface temperature of heat roller 11. Temperature controller circuit 15 is controlled by a main controller, which will be described later, and performs the on/off operation of heater 12 or other control based on the measurement of temperature sensor 14, thus maintaining the surface temperature of heater roller 11 at, for example, 150° C.

Fixing unit 10 has an unillustrated paper discharge sensor for detecting the discharge of paper 5 processed through fixing unit 10.

The materials of heat roller 11, heater 12, pressure roller 13, etc., are not specifically limited. The surface temperature of heat roller 11 also is not specifically limited. Further, fixing unit 10 may use a fixing process which fixes the toner image by heating or pressurizing paper 5.

Further, although it is not shown in the drawing, the paper output side of fixing unit 10 has a paper discharge roller for discharging paper 5 processed through fixing unit 10 onto a paper output tray and a paper output tray for holding paper 5 thus discharged. The aforementioned heat roller 11, pressure roller 13 and paper discharge roller are rotated by an unillustrated driving means.

Toner supplying section 1 as part of image forming unit 3 is composed of a toner storage tank 16 for storing toner 4 as developer particles, a toner support 17 of a cylindrical sleeve for magnetically supporting toner 4, and a doctor blade 18 which is provided inside toner storage tank 16 to electrify toner 4 and regulate the thickness of the toner layer carried on the peripheral surface of toner support 17. Doctor blade 18 is arranged on the upstream side of toner support 17 with respect to the rotational direction, spaced with a distance, e.g., 60 μm, for example, from the peripheral surface of toner support 17. Toner 4 is of a magnetic type having a mean particle diameter of, for example, 6 μm, and is electrified with static charge of −4 μC/g to −5 μC/g by doctor blade 18. Here, the distance between doctor blade 18 and toner support 17 is not particularly limited. The mean particle size, the amount of static charge, etc., of toner 4 are not particularly limited.

Toner support 17 is rotationally driven by an unillustrated driving means in the direction indicated by arrow A in the figure, with its surface speed set at about 100 mm/sec, for example. Toner support 17 is grounded and has unillustrated fixed magnets therein, at the position opposite to doctor blade 18 and at the position opposite to a control electrode 19 (which will be described later). This arrangement permits toner support 17 to carry toner 4 on its peripheral surface. Toner 4 supported on the peripheral surface of toner support 17 is made to stand up in 'spikes' at the areas on the peripheral surface corresponding to the positions of the aforementioned affixed magnets.

Rotating speed of toner support 17 is not limited particularly. Here, the toner is supported by magnetic force, but toner support 17 can be configured so as to support toner 4 by electric force or combination of electric and magnetic forces.

Printing section 2 in image forming unit 3 includes: an opposing electrode 20 which is made up of an aluminum sheet of, for example, 1 mm thick and faces the peripheral surface of toner support 17; a high-voltage power source 21 for supplying a high voltage to opposing electrode 20; a control electrode 19 provided between opposing electrode 20 and toner support 17; a charge eraser brush 22; a charge eraser power source 23 for applying a charge eraser voltage to charge eraser brush 22; a charging brush 24 for charging paper 5; a charger power source 25 for supplying a charger voltage to charging brush 24; a dielectric belt 26; a pair of support rollers **27*a* and 27*b* for supporting and driving dielectric belt 26; and a cleaner blade 28**.

Opposing electrode 20 is provided about 1 mm apart from the outer peripheral surface of toner support 17. Dielectric belt 26 is made of a base of PVDF having a thickness of 75 μm with a volume resistivity of about $10^{10}\Omega$ cm. Dielectric belt 26 is driven by an unillustrated driving means in the direction of the arrow in the drawing, at a surface speed of, for example, 30 mm/sec. Applied to opposing electrode 20 is a high voltage, e.g., 2.3 kV from high-voltage power source (controlling means) 21. This high voltage supplied from high voltage power source 21 generates an electric field between opposing electrode 20 and toner support 17, required for causing toner 4 being supported on toner support 17 to jump toward opposing electrode 20.

Charge eraser brush 22 is pressed against dielectric belt 26 at a position downstream, relative to the rotational direction of dielectric belt 26, and of the area facing control electrode 19. Charge eraser brush 22 has an eraser potential of 2.5 kV applied from charge eraser power source 23 so as to eliminate unnecessary charge on the surface of dielectric belt 26.

If some toner 4 adhered to the surface of dielectric belt 26 due to a contingency such as paper jam, etc., cleaning blade 28 removes this toner 4 to prevent pollution of toner 4 on the underside of paper 5. The material of opposing electrode 20 is not particularly limited. The distance between opposing electrode 20 and toner support 17 is not particularly specified either. Further, the voltage applied to opposing electrode 20 as well as the voltage applied to charge eraser brush 22 is not limited either.

Although unillustrated, the image forming apparatus includes: a main controller as a control circuit for controlling the whole image forming apparatus; an image processor for converting the image data obtained from image pickup device for reading an original image etc., into a format of image data to be printed; an image memory for storage of the image data; and an image forming control unit for converting the image data obtained from the image processor into the image data to be given to control electrode 19.

Control electrode 19 is disposed in parallel to the tangent plane of the surface of opposing electrode 20 and spreads two-dimensionally facing opposing electrode 20, and it has a structure to permit the toner to pass therethrough from toner support 17 to opposing electrode 20. The electrode field formed between toner support 17 and opposing electrode 20 varies depending on the potential being applied to control electrode 19, so that the jumping of toner 4 from toner support 17 to opposing electrode 20 is selectively controlled.

Figure 4:
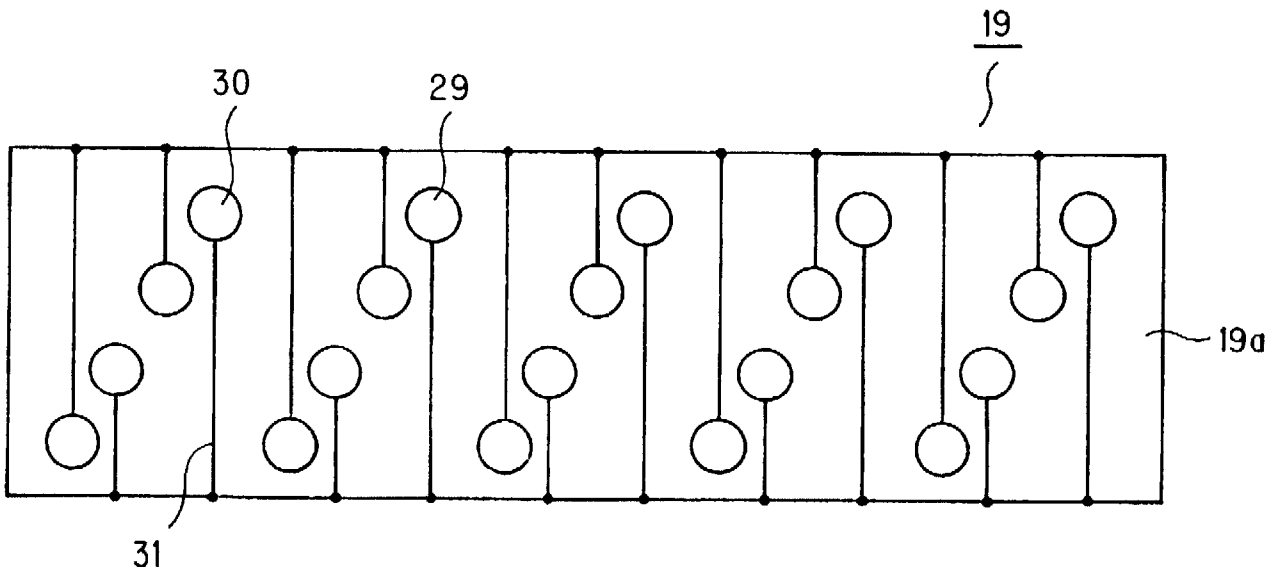
FIG. 4 is a front view showing the essential configuration of the control electrode provided in the image forming apparatus of the invention.

Control electrode 19 is arranged so that its distance from the peripheral surface of toner support 17 is set at 100 μm, for example, and is secured by means of an unillustrated supporter member. As shown in FIG. 4, control electrode 19 is composed of an insulative board **19*a*, a high voltage driver (not shown), annular conductors independent of one another, i.e., annular electrode 29. Board 19*a* is made from a polyimide resin, for example, with a thickness of 25 μm. The board further has holes forming gates 30, to be mentioned later, formed therein. Annular electrode 29 is formed of copper foil, for instance, and is arranged around individual hole in a predetermined manner on the surface which faces toner support 17 of board 19*a*. Each annular electrode 29 is formed 220 μm in diameter and 30 μm thick, for example. Each opening of annular electrode 29 is set at 200 μm in diameter, for example, forming a passage for toner 4 to jump from toner support 17 to opposing electrode 20. This passage will be termed gate 30 hereinbelow. Here, the distance between control electrode 19 and toner support 17** is not specifically limited.

The size of gates 30 and the materials and thickness of board 19*a* and annular electrodes 29 are not particularly limited.

In the above case, gates 30, or annular electrodes 29 are formed at 2,560 sites. Each annular electrode 29 is electrically connected to a control power source 32 (to be described later) via individual feeder lines 31 and a high voltage driver (not shown).

The number of the electrodes corresponds to a resolution of 300 DPI (dot per inch) across the width of A4 sized paper. Here, the number of annular electrodes 29 is not particularly limited. The surface of annular electrodes 29 as well as the surface of feeder lines 31 is coated with an insulative layer (not shown) as thick as 30 μm, thus ensuring insulation between annular electrodes 29, insulation between feeder lines 31, and insulation between annular electrodes 29 and feeder lines 31 which are not connected to each other. The material, thickness etc., of this insulative layer are not particularly limited.

Supplied to annular electrodes 29 of control electrode 19 are voltages or pulses in accordance with the image signal from control power source (controlling means) 32. Specifically, when toner 4 carried on toner support 17 is made to pass toward opposing electrode 20, a voltage, e.g., 150 V is applied to annular electrode 29. When the toner is blocked to pass, a voltage, e.g., −200 V is applied.

In this way, whilst the potential to be imparted to control electrode 19 is controlled in accordance with the image signal, a sheet of paper 5 is fed along opposing electrode 20 on the side thereof facing toner support 17, so that a toner image is formed on the surface of paper 5 in accordance with the image signal. Here, control power source 32 is controlled by a control electrode controlling signal transmitted from an unillustrated image forming control unit.

Figure 5:
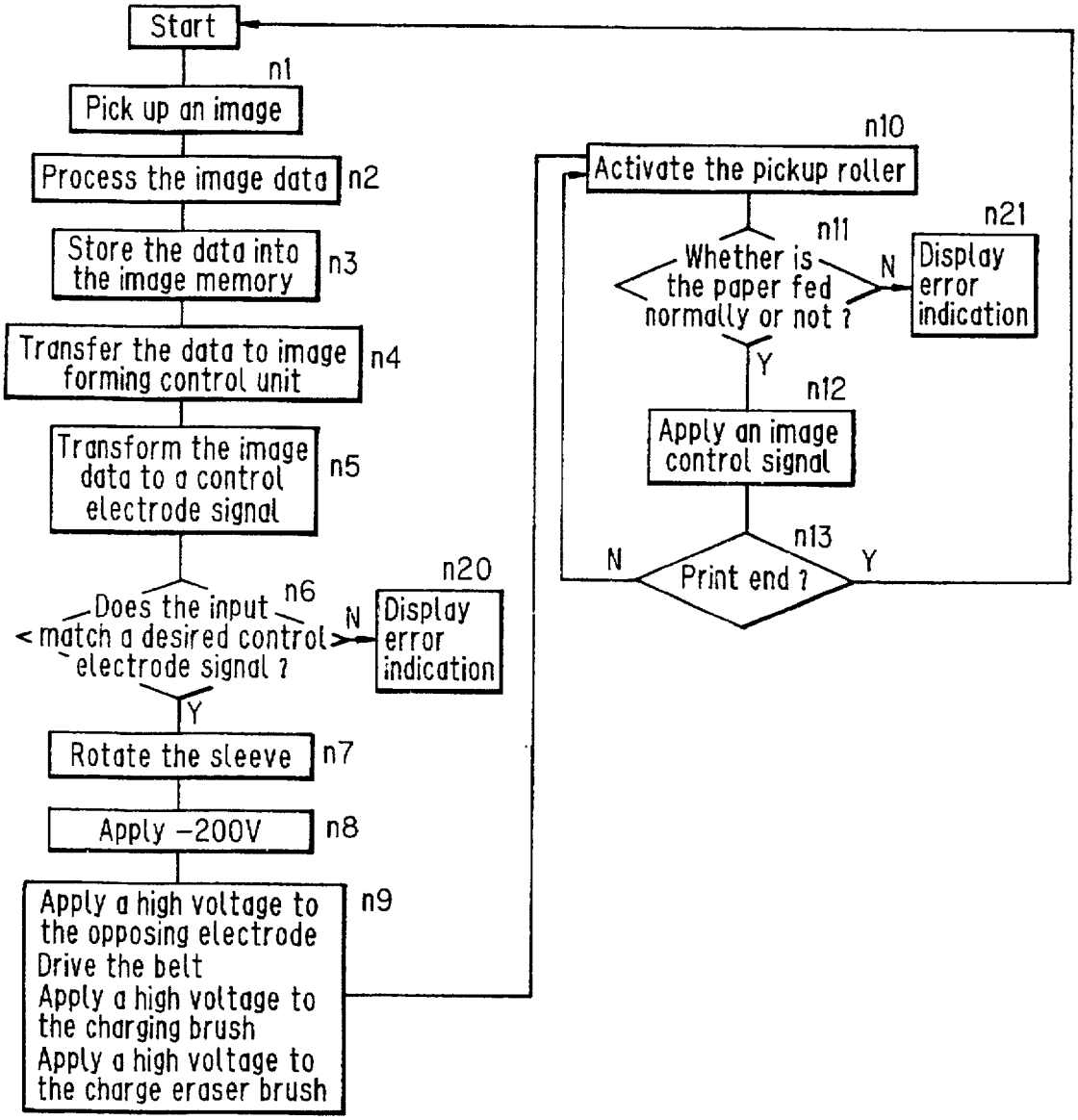
FIG. 5 is a flowchart showing the flow of an image forming control operation in the image forming apparatus of the invention.

Next, the image forming operation performed by this image forming apparatus will be explained with reference to FIG. 5.

First, when the copy start key (not shown) is operated with an original to be copied set on the image pickup section, the main controller receives this input and starts the image forming operation. Illustratively, the image pickup section reads the original image (n1), and the image data is processed in the image processing section (n2) to be stored into the image memory (n3). As the image data stored in this image memory is transferred to the image forming control unit (n4), it starts to transform the input image data into a control electrode controlling signal to be imparted to control electrode 19 (n5). When the image forming control unit acquires a predetermined amount of the control signal to be supplied to the control electrode (n6-yes), an unillustrated driver rotates toner support (sleeve) 17 (n7) while a control power source 32 applies a potential of −200V so as to prevent the jumping of toner toward annular electrodes 29 of control electrodes 19 (n8). Thereafter, an unillustrated driver operates (n7) to rotate pickup roller 8 shown in FIG. 3. When this roller delivers a sheet of paper 5 from paper cassette 7 toward image forming unit 3 (n10), the paper feed sensor detects the fact that the feed of paper is normal (n11). Paper 5 delivered out by pickup roller 8 is conveyed between charging brush 24 and support roller 27*a*. Support rollers 27*a* and 27*b* are applied from high voltage power source 21 with the same voltage as that applied to opposing electrode 20 (n9). Charging brush 24 is applied with a charging potential of 1.2 kV by charger power source 25 (n9). Paper 5 is supplied with charge due to the potential difference between charging brush 24 and support rollers 27*a*, 27*b*. Electrostatically attracted to dielectric belt 26, paper 5 is conveyed with the advance of the belt, to a position in printing section 2 of image forming unit 3, where dielectric belt 26 faces toner support 17. The aforementioned predetermined amount of the control electrode controlling signal varies depending on the configuration of the image forming apparatus used and other factors.

Thereafter, the image forming control unit supplies the control electrode controlling signal to control power source 32. This control electrode controlling signal is supplied at a time synchronized with the supply of paper 5 from charging brush 24 to printing section 2. Control power source 32 controls the voltages to be applied to annular electrodes 29 of control electrode 19 based on the control electrode controlling signal. Illustratively, the voltage, 150 V or −200 V is appropriately applied to each of predetermined annular electrodes 29 from control power source 32 so as to control the electric field around control electrode 19. Accordingly, at each gate 30 of control electrode 19, the jumping of toner 4 from toner support 17 toward opposing electrode 20 is prevented or permitted appropriately in accordance with the image data. Thus, a toner image in conformity with the image signal is formed on paper 5 which is moving at the rate of 30 mm/sec toward the paper output side by the advance of dielectric belt 26.

Paper 5 with the toner image formed thereon is separated from dielectric belt 26 by the curvature of support roller 27*b* and is conveyed to fixing unit 10, where the toner image is fixed to paper 5. Paper 5 with the toner image fixed thereon is discharged by the discharge roller onto paper output tray. At the same time, the fact that the paper is normally discharged is detected by the paper discharge sensor. From this detection, the main controller judges that the printing operation has been normally achieved (n13).

By the image forming operation described above, a good image is created on paper 5. Since this image forming apparatus directly forms the image on paper 5, it is no longer necessary to use a developer medium such as photoreceptor, dielectric drum or the like, which was used in conventional image forming apparatuses.

As a result, the transfer operation for transferring the image from the developer medium to a sheet of paper 5 can be omitted, thus eliminating degradation of the image and improving the reliability of the apparatus. Since the configuration of the apparatus can be simplified needing fewer parts, it is possible to reduce the apparatus in size and cost.

Now, the jumping of toner 4 from toner support 17 to opposing electrode 20 caused by the voltage application therebetween will be considered.

As stated already, toner support 17 is grounded while a high voltage, i.e., 2.3 kV is applied to opposing electrode 20. In this condition, paper 5 will have a surface potential of 2 kV due to the equilibrium of the surface charges of paper 5. As a result, equipotential surfaces from 0 V to 2 KV are formed at regular intervals between toner support 17 and opposing electrode 20. Opposing electrode 20 is arranged 1 mm apart from peripheral surface of toner support 17, and control electrode 19 is set up 100 μm apart from the peripheral surface of toner support 17. Therefore, the potential at the center of each gate 30 (each gate center) of control electrode 19 is set at about 200 V. Here, the potential at the center of each gate 30 will be determined by the potential difference between toner support 17 and opposing electrode 20, the geometry of control electrode 19, the shape of gates 30, etc.

Figure 6:
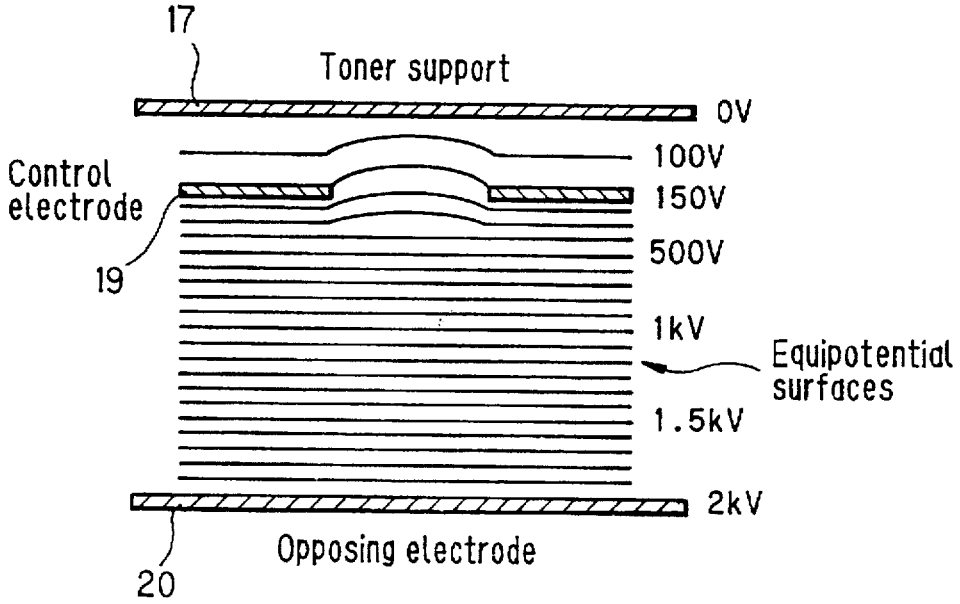
FIG. 6 is an illustrative view showing equipotential surfaces in the image forming section of the image forming apparatus of the invention when the toner is caused to jump.
Figure 7:
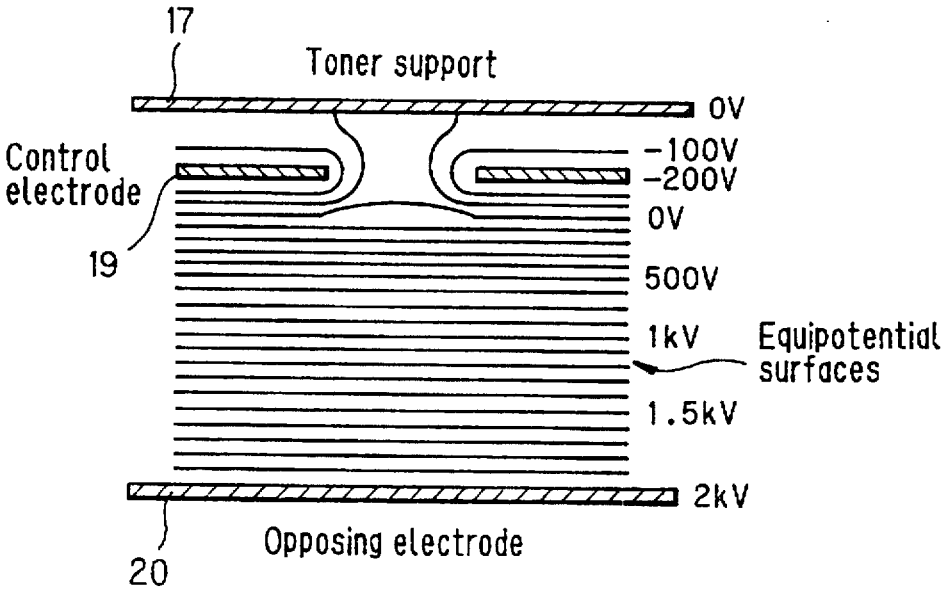
FIG. 7 is an illustrative view showing equipotential surfaces in the image forming section of the image forming apparatus of the invention when the toner is stopped to jump.

In this condition, in order for toner 4 carried on toner support 17 to pass toward opposing electrode 20, control power source 32 is caused to apply a voltage of 150 V to annular electrodes 29 of control electrode 19, for 150 μsec per pixel. When this voltage is applied, the equipotential surfaces near gate 30 of control electrode 19 are obtained as shown in FIG. 6. Similarly, when a voltage of −200 which will not permit toner 4 to pass through gate 30 is applied, the equipotential surfaces as shown in FIG. 7 are formed. Here, the equipotential surfaces shown in FIGS. 6 and 7 are those determined using computer simulation by the inventor of this application.

In this way, the direction of the electric field between control electrode 19 and toner support 17 becomes inverted depending upon the voltage applied to control electrode 19. Nevertheless, the electric field between control electrode 19 and opposing electrode 20 only varies in its intensity more or less; the direction of the field remains perpendicular to the surface of the paper, constantly, or will not vary. Accordingly, the state of jumping toner 4 which is past control electrode 19 will hardly be affected by the potential of control electrode 19.

In the above description, the voltage applied to annular electrodes 29 of control electrode 19 for allowing passage of toner 4 was set at 150 V as an example. This voltage, however, is not specifically limited as long as the jumping control of toner 4 can be performed as desired. It is possible to change the extent to which the equipotential surfaces swell or curve toward toner support 17 in the vicinity of gates 30 of control electrode 19, by changing the potential applied to annular electrodes 29 of control electrode 19. Therefore, it is possible to vary the electric force acting on toner 4 passing through gates 30. This means that appropriate variation in the potential imparted from control power source 32 enables the dot size (FL) of the image formed on paper 5 to be adjusted arbitrarily.

The voltage to be imparted to annular electrodes 29 of control electrode 19 to prevent passage of toner 4 should not be particularly limited. The above potential may be determined in practice by carrying out experiments etc.

Figure 8:
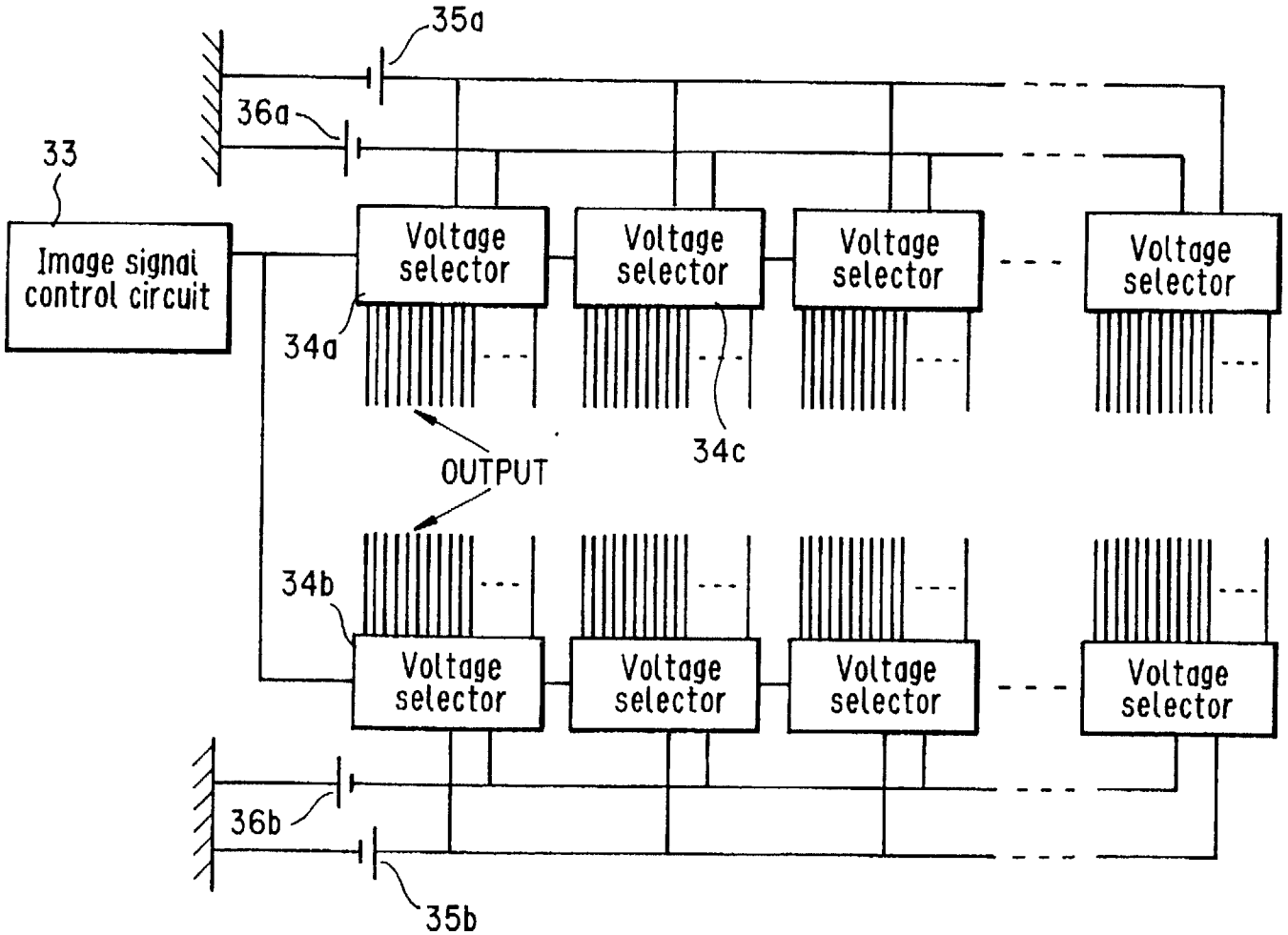
FIG. 8 is an illustrative view for explaining the control power source in the embodiment of the invention.

Referring now to FIG. 8, the configuration of control power source 32 will be considered. As shown in FIG. 8, control power source 32 includes an image signal control circuit 33, and voltage selectors 34*a*, 34*b* and 34*c* having high-voltage drivers and resistors. The outputs from voltage selectors 34*a*, 34*b* and 34*c* are connected to annular electrodes 29. As shown in FIG. 8, 35*a* and 35*b* designate power sources of 150 V; 36*a* and 36*b* designate power sources of −200 V. These power sources are adapted to supply the voltages to voltage selectors 34*a* and 34*b*, respectively, as shown in FIG. 8.

Each power source has a current capacity of 60 mA, and can supply voltage to 1280 annular electrodes 29, half the number of 2560, needed to print across a width of A4 size at 300 DPI.

Figure 1:
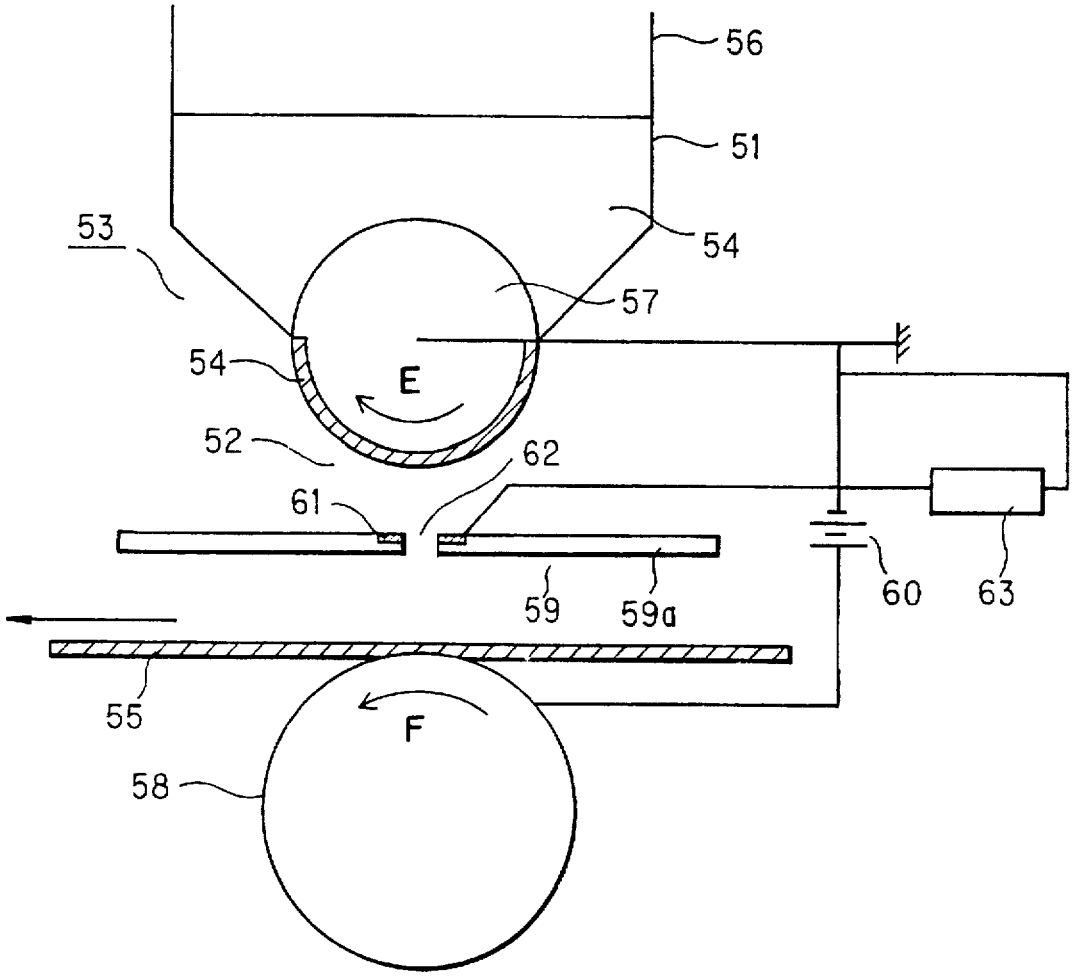
FIG. 1 PRIOR ART
FIG. 1 is an illustrative view for explaining the prior art.
Figure 2:
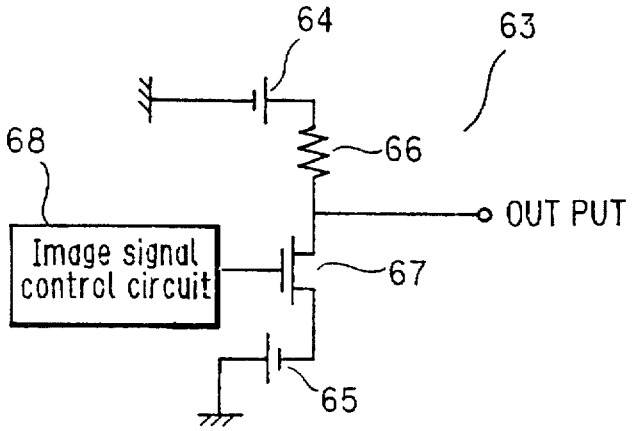
FIG. 2 PRIOR ART
FIG. 2 is an illustrative view for explaining a control means in the prior art.
Figure 9:
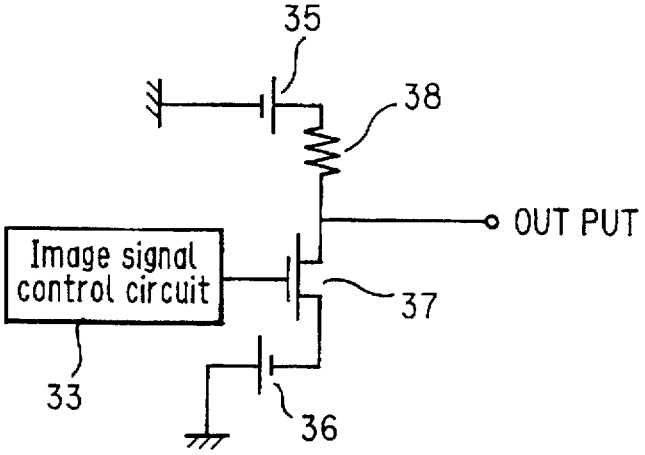
FIG. 9 is an illustrative view showing an example of one typical channel in the voltage selector in the control power source in the embodiment of the invention.
Figure 10:
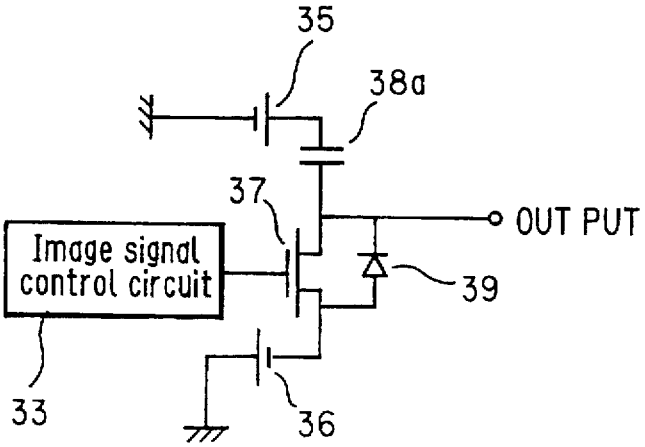
FIG. 10 is an illustrative view showing another example of one typical channel in the voltage selector in the control power source in the embodiment of the invention.

Each channel in voltage selectors 34*a*, 34*b* has a configuration shown in FIG. 9 or FIG. 10. The configuration of FIG. 9 includes an FET 37 and a resistor 38. This is basically the same as the conventional configuration shown in FIG. 2. In this case, the resistance of resistor 38 is 10 MΩ. Therefore, when FET 37 is on, the current through resistor 38 and FET 37 is $350/10^7=3.5\times10^{-5}$A. The current flowing through −200 V power source 36*a* or 150 V power source 35*a*, or the total for 1280 channels, becomes equal to about 45 mA ($3.5\times10^{-5}\times1280=4.5\times10^{-2}$).

The other configuration for one channel in voltage selectors 34*a*, 34*b* is composed of an FET 37, capacitor 38*a* of 15 pF, a diode 39, as shown in FIG. 10. When FET 37 is on, −200 V is supplied to the output from power source 36, whereas when FET 37 is off, 150 V is supplied to it from power source 35.

In this embodiment, since capacitor 38*a* is used in place of the resistor, no current flows while FET 37 is on. Accordingly, constant generation of heat will not occur, so that it is no longer necessary to cool FET 37.

Figure 11:
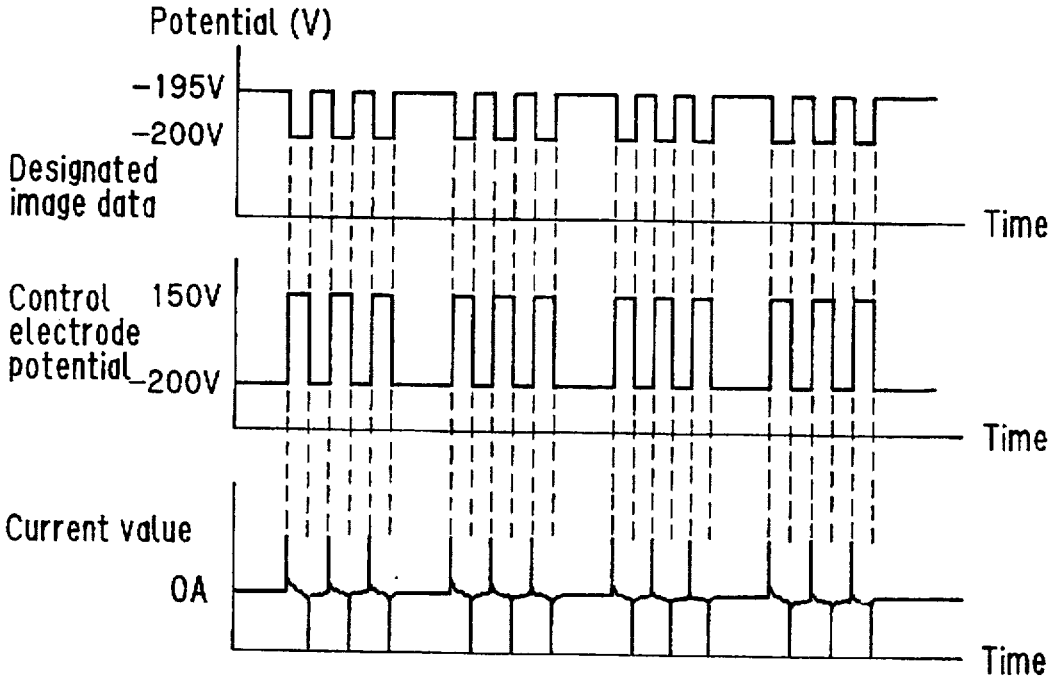
FIG. 11 is an illustrative view for explaining the potentials and current applied to the control electrode by voltage selector in the image forming apparatus of the invention.

However, the moment FET 37 is changed from the on-state to the off-state, or the moment it is changed from off to on, a momentary current flows as a transient effect, as shown in FIG. 11. Since this current lasts for a very short time, generation of heat in FET due to this current is decreased compared to the prior art.

From the stand point of the power source, even if the transient current for each channel lasts for a very short time, a considerably large amount of current flows from the power source because a number of FETs 37 are repeatedly turned on and off and the current for all the channels is supplied from the power source connected thereto.

For example, the average of the transient current with respect to time in this embodiment is $4.6\times10^{-5}$ A. Therefore, the current from power source 36*a* or 35*a* for 1280 channels is $4.6\times10^{-5}\times1280=5.8\times10^{-2}$ A=58 mA.

In this embodiment, the supply of a single potential to 2560 channels in total is shared by two power sources, the current supply from one power source may be of 58 mA, as stated above. If only one power source is used for a single potential, the power source needs simply twice the above current capacity, or 116 mA. In this case, the power source becomes bulky and suffers from heat generation. In such a case where a large power source is used, if due to some contingent the voltage is applied to other circuits or the apparatus frame which can be directly touched by the user, other circuits or other apparatuses which are connected thereto may be broken and the user might be struck by electricity.

In general, the human body is adversely affected if a current above 70 mA at over about 40 V is passed therethrough. Also, if this happens, the power source or the current circuit may generate heat, possibly causing a grave danger of fire breaking out.

This embodiment can avoid all these hazards. Specifically, since −200 V power sources 36*a*, 36*b*, and 150 V power sources 35*a*, 35*b* can avoid heat generation due to the supplied current, no cooling means is needed. Further, even if portions accessible by the user are applied with a certain voltage due to the occurrence of some contingent, the hazard of electric shock can be avoided.

In the above embodiment, the power supplying means is composed of two types of power sources, or −200 V power source 36*a*, 36*b* and 150 V power source 35*a*, 35*b*, the number of power sources can be changed appropriately in conformity with the characteristic of the apparatus.

Figure 12:
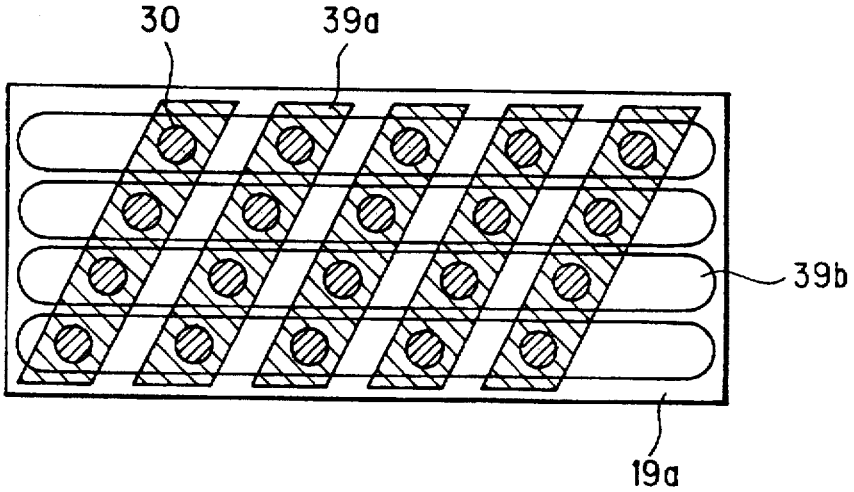
FIG. 12 is an illustrative view for explaining a configuration of the control electrode of the image forming apparatus of the invention wherein the control electrode is in the form of a matrix control configuration.

In the above description of the embodiment, control electrode 19 with annular electrodes 29 was explained as an example, but the configuration of it is not particularly limited. For example, in place of annular electrodes 29, it is possible to provide a matrix control configuration as shown in FIG. 12, where a plurality of strip-like column electrodes 39*a* and strip-like row electrodes 39*b* are formed on the front and rear surfaces of board 19*a* of control electrode 19, respectively, and application of voltages to column electrodes 39*a* and row electrodes 39*b* crossing over each other is controlled to govern the jumping of toner 4 from toner support 17 to opposing electrode 20.

Further, in accordance with this embodiment, an image forming apparatus for monochrome print was illustrated, but the present invention can also be applied to a color image forming apparatus which has a plurality of toner supplying sections 1*a*, 1*b*, 1*c* and 1*d* and printing sections 2*a*, 2*b*, 2*c* and 2*d*, where toner supplying sections 1 are filled with color toners, e.g., yellow (1*a*), magenta (1*b*), cyan (1*c*) and black (1*d*), respectively.

In the description of the embodiment, the example where the toner is used as the developer particles was explained, but ink or other material can be used as the developer particles. It is also possible to construct toner supplying section 1 with a structure using an ion flow process. Specifically, the image forming unit may include an ion source such a corona charger or the like. Also in this case, it is possible to have the same effect as stated above.

The image forming apparatus in accordance with the invention can be preferably applied to the printing unit in digital copiers, facsimile machines as well as to digital printers, plotters, etc.

As stated above, in the image forming apparatus in accordance with the first feature of the invention, since a plurality of power sources for supplying voltage to the control electrode are used, power sources with low capacities can be used, thus preventing heat generation and current leakage from the power sources. Accordingly, no cooling means is needed any more, enabling the apparatus itself to be compact.

As stated above, in the image forming apparatus in accordance with the second feature of the invention, a plurality of power sources for supplying voltage to the control electrode are used and the current from each of them is set under 70 mA, it is possible to avoid breaking the electric circuits and the hazard of electric shock to the user, without necessity of a high-level insulating means, thus making it possible to reduce the cost.

As stated above, in the image forming apparatus having the third or fourth feature of the invention, since a plurality of power sources for supplying voltage to each of electrodes are also used when a matrix control configuration is applied to the control electrode, power sources with low capacities can be used, thus preventing heat generation and current leakage from the power sources. Accordingly, no cooling means is needed any more, enabling the apparatus itself to be compact.

As stated above, in the image forming apparatus in accordance with the fifth feature of the invention, a plurality of power sources for supplying voltages are also used when either single control or matrix control is applied to the control electrodes in a color image forming apparatus and the current from each of them is set under 70 mA, it is possible to avoid breaking the electric circuits and the hazard of electric shock to the user, without necessity of a high-level insulating means, thus making it possible to reduce the cost.

As stated above, in the image forming apparatus in accordance with the sixth feature of the invention, since the voltage is applied to the selector through a capacitance element, pulse current hardly flows in contrast to the case where a resistance element was used. As a result, it is possible to reduce not only the current capacity of the power source but also that of the selector. Further, by using a plurality of power sources, it is also possible to keep the average current from each of the power sources low. Accordingly, it is possible to avoid heat generation due to current and voltage drop occurring when the applied voltage to the control electrode is changed over. Further, since no adverse effects due to heat generation will arise, there is no need of providing a cooling means, thus making it possible to reduce the apparatus in size and cost, needing fewer parts.

Further, in the image forming apparatus in accordance with the seventh feature of the invention, since the use of a plurality of power sources can keep the current from each of them low and since each current capacity is set under 70 mA, it is possible to prevent the hazard of electric shock due to current leakage and the breakdown in other circuits or apparatuses, without necessity of a large-scale insulating means.

In accordance with the image forming apparatus of the eighth feature of the invention, it is possible to have the same effect as stated above even when the control electrode is in the form of a matrix control configuration.

In accordance with the image forming apparatus of the ninth feature of the invention, it is possible to have the same effect as stated above even when color toner is used.

In accordance with the image forming apparatuses of the sixth through ninth features of the invention, since capacitance elements can be printed on an FPC board, it is possible to reduce the size and cost of the circuit, needing fewer parts.

What is claimed is:

1. An image forming apparatus comprising:

a supporting means for supporting developer particles;

an opposing electrode disposed facing the supporting means;

a control electrode disposed between the supporting means and the opposing electrode and having a plurality of gates which form passages for the developer particles;

a recording medium which is conveyed between the control electrode and the opposing electrode and is recorded with an image; and a controlling means which generates a predetermined potential difference between the supporting means and the opposing electrode and, by varying the potential applied to the control electrode, controls passage of the gates for the developer particles so as to create the image on the recording medium which is conveyed between the control electrode and the opposing electrode, wherein a plurality of voltage supplying means are provided to supply voltages to the control electrodes, where each voltage supplying means has a maximum current supplying capacity of under 70 mA.

2. An image forming apparatus comprising:

a supporting means for supporting developer particles;

a driving means for driving the supporting means at a certain surface speed;

an opposing electrode disposed facing the supporting means;

a control electrode, which is disposed between the supporting means and the opposing electrode, has a plurality of gates which form passages for the developer particles, and includes a first and second control electrode group, each composed of a plurality of electrodes formed around the plural gates, so that the developer particles can be caused to jump toward the recording medium through the openings corresponding to selected electrodes in accordance with the voltage applied thereto;

controlling means which applies a predetermined potential difference to the electrodes corresponding to the first and second electrode groups when the developer particles pass through the openings; and a plurality of voltage supplying means for supplying voltages to the control electrodes, wherein each voltage supplying means has a maximum current supplying capacity of under 70 mA, and wherein an image is formed by controlling passage of the developer particles through the gates by applying the predetermined voltage to the electrodes corresponding to the first and second electrode groups.

3. An image forming apparatus comprising:

a supporting means for supporting developer particles;

an opposing electrode disposed facing the supporting means;

a control electrode disposed between the supporting means and the opposing electrode and having a plurality of gates which form passages for the developer particles;

a recording medium which is conveyed between the control electrode and the opposing electrode and is recorded with an image; and a controlling means which generates a predetermined potential difference between the supporting means and the opposing electrode and, by varying the potential applied to the control electrode, controls passage of the gates for the developer particles so as to create the image on the recording medium which is conveyed between the control electrode and the opposing electrode, wherein the controlling means comprises:

at lease two, a first and a second voltage supplying means, the first voltage supplying means applying a first level of voltage to set the gates of the control electrode into a first state in which the developer particles are permitted to pass therethrough, and the second voltage supplying means applying a second level of voltage to set the gates of the control electrode into a second state in which the developer particles are prohibited from passing therethrough;

an element providing capacitance; and a voltage selecting means for selecting one level from multiple levels of voltage containing the first and second levels of voltage to apply the selected voltage to the control electrode, at least one of the first and second voltage supplying means having a plurality of powers sources, and at least one of the first and second voltages being supplied to the voltage selecting means by way of the element providing capacitance.

4. An image forming apparatus according claim 3, wherein the first and second voltage supplying means both have a maximum current supplying capacity of under 70 mA.

5. An image forming apparatus comprising:

a supporting means for supporting developer particles;

a driving means for driving the supporting means at a certain surface speed;

an opposing electrode disposed facing the supporting means;

a control electrode, which is disposed between the supporting means and the opposing electrode, has a plurality of gates which form passages for the developer particles, and includes a first and second control electrode group, each composed of a plurality of electrodes formed around the plural gates, so that the developer particles can be caused to jump toward the recording medium through the openings corresponding to selected electrodes in accordance with the voltage applied thereto;

controlling means which applies a predetermined potential difference to the electrodes corresponding to the first and second electrode groups when the developer particles pass through the openings; and a plurality of voltage supplying means for supplying voltages to the control electrodes, wherein the controlling means comprises:

at lease two, a first and a second voltage supplying means, the first voltage supplying means applying a first level of voltage to set the gates of the control electrode into a first state in which the developer particles are permitted to pass therethrough, and the second voltage supplying means applying a second level of voltage to set the gates of the control electrode into a second state in which the developer particles are prohibited from passing therethrough;

an element providing capacitance; and a voltage selecting means for selecting one level from multiple levels of voltage containing the first and second levels of voltage to apply the selected voltage to the control electrode, at least one of the first and second voltage supplying means having a plurality of powers sources, and at least one of the first and second voltages being supplied to the voltage selecting means by way of the element providing capacitance.

* * * * *